US011879677B2

(12) United States Patent
Sakabe et al.

(10) Patent No.: US 11,879,677 B2
(45) Date of Patent: Jan. 23, 2024

(54) AIR-CONDITIONING APPARATUS

(71) Applicant: Mitsubishi Electric Corporation, Tokyo (JP)

(72) Inventors: Akinori Sakabe, Tokyo (JP); Masanori Sato, Tokyo (JP); Naoki Nakagawa, Tokyo (JP); Atsushi Kawashima, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 458 days.

(21) Appl. No.: 17/292,543

(22) PCT Filed: Jan. 16, 2019

(86) PCT No.: PCT/JP2019/001094
§ 371 (c)(1),
(2) Date: May 10, 2021

(87) PCT Pub. No.: WO2020/148826
PCT Pub. Date: Jul. 23, 2020

(65) Prior Publication Data

US 2022/0003467 A1 Jan. 6, 2022

(51) Int. Cl.
*F25B 13/00* (2006.01)
*F25B 41/42* (2021.01)
(Continued)

(52) U.S. Cl.
CPC ..... *F25B 41/42* (2021.01); *F24F 1/0063* (2019.02); *F25B 5/00* (2013.01); *F25B 13/00* (2013.01);
(Continued)

(58) Field of Classification Search
CPC .... F25B 41/42; F25B 1/20; F25B 5/00; F25B 13/00; F25B 2400/0409; F25B 2600/2501; F25B 2700/2103; F24F 1/0063
(Continued)

(56) References Cited

FOREIGN PATENT DOCUMENTS

CN 101395436 A * 3/2009
CN 108698476 A * 10/2018
(Continued)

OTHER PUBLICATIONS

International Search Report dated Mar. 12, 2019, issued in corresponding International Application PCT/JP2019/001094 (and English translation).

*Primary Examiner* — Davis D Hwu
(74) *Attorney, Agent, or Firm* — POSZ LAW GROUP, PLC

(57) ABSTRACT

An air-conditioning apparatus includes a load-side heat exchanger including a first heat exchanger disposed on a windward of a second heat exchanger in a direction of an air flow generated by an air-sending device. The air flow passing through the first heat exchanger passes through a second heat exchanger. During cooling operation, a bypass valve causes a part of refrigerant flowing through a first refrigerant pipe to flow through a coupling pipe through a bypass pipe. During heating operation, the bypass valve blocks a flow of the refrigerant flowing from the coupling pipe toward the first refrigerant pipe through the bypass pipe, and causes all of the refrigerant flowing through the coupling pipe to flow from the coupling pipe to the first heat exchanger.

8 Claims, 4 Drawing Sheets

(51) Int. Cl.
*F24F 1/0063* (2019.01)
*F25B 41/20* (2021.01)
*F25B 5/00* (2006.01)

(52) U.S. Cl.
CPC ..... *F25B 41/20* (2021.01); *F25B 2400/0409* (2013.01); *F25B 2600/2501* (2013.01); *F25B 2600/2507* (2013.01); *F25B 2700/2103* (2013.01)

(58) Field of Classification Search
USPC ..... 62/160
See application file for complete search history.

(56) References Cited

FOREIGN PATENT DOCUMENTS

| | | | | |
|---|---|---|---|---|
| JP | 2013180628 | A | * | 9/2013 |
| WO | 2015/063853 | A1 | | 5/2015 |

* cited by examiner

AIR-CONDITIONING APPARATUS

CROSS REFERENCE TO RELATED APPLICATION

This application is a U.S. national stage application of PCT/JP2019/001094 filed on Jan. 16, 2019, the contents of which are incorporated herein by reference.

TECHNICAL FIELD

The present disclosure relates to an air-conditioning apparatus including a plurality of heat exchangers on a load side.

BACKGROUND ART

For example, Patent Literature 1 discloses, as some air-conditioning apparatus including a plurality of heat exchangers on a load side, an air-conditioning apparatus configured to switch between cooling operation in which load-side heat exchangers are used as evaporators and heating operation in which the load-side heat exchangers are used as condensers. The air-conditioning apparatus disclosed in Patent Literature 1 includes, as the load-side heat exchangers, an upper-stage heat exchanger and a lower-stage heat exchanger. In Patent Literature 1, during the cooling operation, the upper-stage heat exchanger and the lower-stage heat exchanger are connected in parallel to each other to increase the number of refrigerant flow paths communicating with inlets and outlets of the load-side heat exchangers. This configuration prevents deterioration of evaporation performance caused by refrigerant pressure loss. Further, in Patent Literature 1, during the heating operation, the upper-stage heat exchanger and the lower-stage heat exchanger are connected in series to decrease the number of refrigerant flow paths communicating with the inlets and the outlets of the load-side heat exchangers. This configuration prevents lowering in a flow speed of refrigerant and lowering in in-pipe heat transfer coefficient. Further, in the air-conditioning apparatus disclosed in Patent Literature 1, flow control valves are each provided to refrigerant inflow ports of the upper-stage heat exchanger and the lower-stage heat exchanger during the cooling operation, and a flow rate of the refrigerant passing through an inside of each of the heat exchangers is controlled on the basis of air-volume distribution of air passing through each of the heat exchangers.

CITATION LIST

Patent Literature

Patent Literature 1: International Publication No. WO 2015/063853

SUMMARY OF INVENTION

Technical Problem

In the air-conditioning apparatus disclosed in Patent Literature 1, each of the plurality of heat exchangers is provided with a refrigerant control valve, and flow path control is exercised by the plurality of refrigerant control valves during the cooling operation and during the heating operation to mechanically switch the refrigerant flow paths, so that cooling performance and heating performance are improved to the extent possible. For example, to apply the air-conditioning apparatus disclosed in Patent Literature 1 to a home air-conditioning apparatus, it is necessary to downsize the air-conditioning apparatus because of restriction in installation dimensions. However, a problem remains in that downsizing of the air-conditioning apparatus is difficult as it is necessary for the air-conditioning apparatus disclosed in Patent Literature 1 to secure a space that houses a number of control valves exercising the flow path control.

Further, in the air-conditioning apparatus disclosed in Patent Literature 1, the upper-stage heat exchanger and the lower-stage heat exchanger, which are the load-side heat exchangers, are arranged in parallel to a direction in which air passes through the load-side heat exchangers. If the upper-stage heat exchanger and the lower-stage heat exchanger in the air-conditioning apparatus disclosed in Patent Literature 1 are uneven in wind speed distribution of the air passing through the upper-stage heat exchanger and the lower-stage heat exchanger, heat loads of the upper-stage heat exchanger and the lower-stage heat exchanger may be nonuniform. Further, even when the upper-stage heat exchanger and the lower-stage heat exchanger are uneven in wind speed distribution, if a heat transfer area of the upper-stage heat exchanger and a heat transfer area of the lower-stage heat exchanger are different from each other, the heat loads of the upper-stage heat exchanger and the lower-stage heat exchanger may be nonuniform.

In the air-conditioning apparatus disclosed in Patent Literature 1, in particular, in a case where the heat loads of the upper-stage heat exchanger and the lower-stage heat exchanger become nonuniform during the cooling operation in which the load-side heat exchangers are used as evaporators, the refrigerant may dry out in one of the upper-stage heat exchanger and the lower-stage heat exchanger. A phenomenon in which refrigerant dries out refers to a phenomenon in which two-phase refrigerant is changed to gas-phase refrigerant through phase change in the internal flow path of a heat exchanger and thus heat is not successfully exchanged at the heat exchanger for lack of two-phase refrigerant. If the refrigerant dries out in the heat exchanger, a heat transfer coefficient of the refrigerant is significantly decreased, and the cooling performance of the air-conditioning apparatus is decreased. To prevent the refrigerant from drying out in the air-conditioning apparatus disclosed in Patent Literature 1, it is necessary to further provide the flow control valves in the upper-stage heat exchanger and the lower-stage heat exchanger, so that more space that houses the flow control valves is required. In the air-conditioning apparatus disclosed in Patent Literature 1, a problem thus remains in that it is difficult to downsize the air-conditioning apparatus while maintaining the cooling performance.

The present disclosure is made to solve the above-described problems, and an object of the present disclosure is to provide an air-conditioning apparatus that achieves both of cooling performance and heating performance that are improved to the extent possible and reduction in size of the air-conditioning apparatus.

Solution to Problem

An air-conditioning apparatus of an embodiment of the present disclosure includes a refrigerant circuit through which refrigerant circulates, the refrigerant circuit including a compressor, a refrigerant flow switching device, a heat source-side heat exchanger, a decompression device, a load-side heat exchanger, a first refrigerant pipe, a coupling pipe, and a second refrigerant pipe, the load-side heat exchanger including a first heat exchanger and a second heat exchanger, the first refrigerant pipe connecting the decompression device and the first heat exchanger, the coupling pipe connecting the first heat exchanger and the second heat exchanger, the second refrigerant pipe connecting the second heat exchanger and the refrigerant flow switching device; an air-sending device configured to generate an air flow passing through the load-side heat exchanger; a bypass pipe connecting the first refrigerant pipe and the coupling pipe; and a bypass valve disposed in the bypass pipe. The refrigerant flow switching device is configured to switch between cooling operation that causes the refrigerant with low pressure flowing out from the load-side heat exchanger to be suctioned into the compressor and heating operation that causes the refrigerant with high pressure discharged from the compressor to flow into the load-side heat exchanger. The first heat exchanger is disposed on windward of the second heat exchanger in a direction of the air flow generated by the air-sending device, and the air flow passing through the first heat exchanger passes through the second heat exchanger. During the cooling operation, the bypass valve is configured to cause a part of the refrigerant flowing through the first refrigerant pipe to flow through the coupling pipe through the bypass pipe. During the heating operation, the bypass valve is configured to block a flow of the refrigerant flowing from the coupling pipe toward the first refrigerant pipe through the bypass pipe, and cause all of the refrigerant flowing through the coupling pipe to flow from the coupling pipe to the first heat exchanger.

Advantageous Effects of Invention

In the air-conditioning apparatus of an embodiment of the present disclosure, during the cooling operation, the refrigerant flowing out from the decompression device is divided into a main refrigerant flow flowing into the first heat exchanger and a bypass flow flowing into the coupling pipe through the bypass pipe and the bypass valve, before the refrigerant flows into the second heat exchanger. The main refrigerant flow with heat having been exchanged in the first heat exchanger is merged again with the bypass flow that has passed through the bypass valve, in the coupling pipe, and the resultant refrigerant flows into the second heat exchanger. Therefore, the pressure loss of the refrigerant passing through the first heat exchanger is reduced by a simple configuration including the bypass pipe and the bypass valve. Further, as the first heat exchanger is disposed on the windward of the second heat exchanger, and the air flow passing through the first heat exchanger passes through the second heat exchanger, the refrigerant does not dry out because of difference in heat load between the first heat exchanger and the second heat exchanger. Moreover, during the heating operation, as the first heat exchanger is connected in series with the second heat exchanger, the flow speed of the refrigerant in the second heat exchanger is increased to enhance the in-pipe heat transfer coefficient. Consequently, according to an embodiment of the present disclosure, it is possible to provide the air-conditioning apparatus that achieves both of the cooling performance and the heating performance that are improved to the extent possible and reduction in size of the air-conditioning apparatus.

DESCRIPTION OF EMBODIMENTS

Embodiment 1

Figure 1:
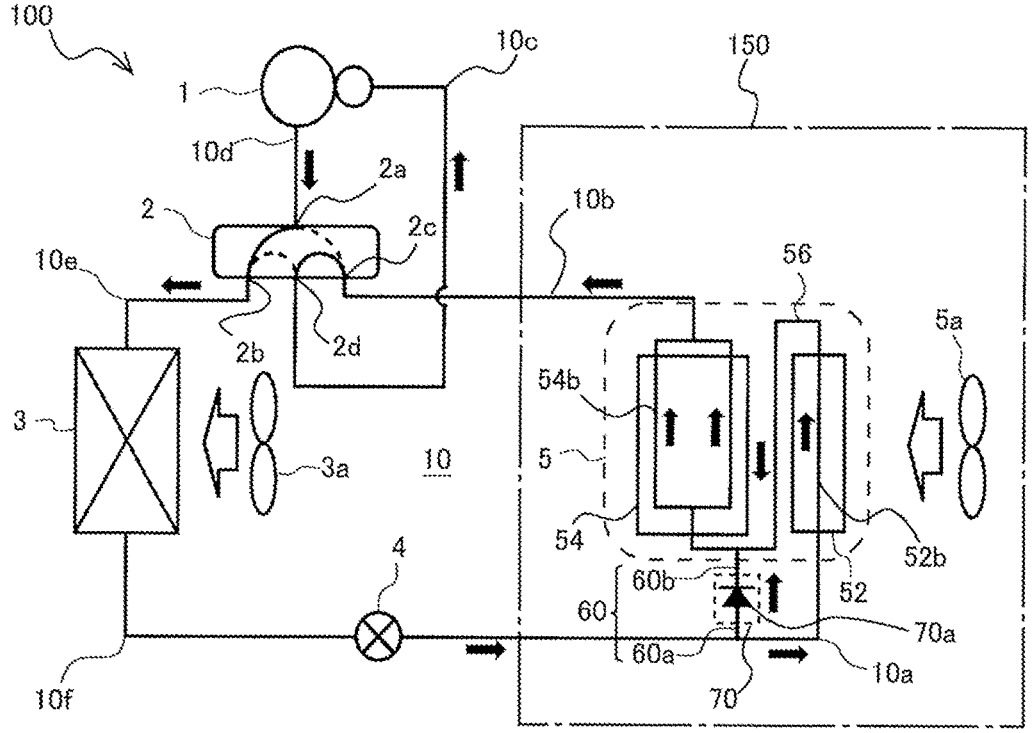
FIG. 1 is a schematic refrigerant circuit diagram illustrating an example of a refrigerant circuit during cooling operation of an air-conditioning apparatus according to Embodiment 1 of the present disclosure.

An air-conditioning apparatus 100 according to Embodiment 1 of the present disclosure will be described. FIG. 1 is a schematic refrigerant circuit diagram illustrating an example of a refrigerant circuit 10 during cooling operation of the air-conditioning apparatus 100 according to Embodiment 1. Black arrows illustrated in FIG. 1 each indicate a flow direction of refrigerant during the cooling operation. Outlined block arrows illustrated in FIG. 1 each indicate a flow direction of an air flow.

In the following drawings including FIG. 1, dimensional relationships of components and shapes of the respective components are different from actual dimensional relationships and actual shapes in some cases. Further, in the following drawings, the same or similar components are denoted by the same reference signs.

The air-conditioning apparatus 100 includes the refrigerant circuit 10 including a compressor 1, a refrigerant flow switching device 2, a heat source-side heat exchanger 3, a decompression device 4, and a load-side heat exchanger 5. The refrigerant circuit 10 is formed such that the compressor 1, the heat source-side heat exchanger 3, the decompression device 4, and the load-side heat exchanger 5 are connected through refrigerant pipes to circulate the refrigerant.

The compressor 1 is a fluid machine that compresses suctioned low-pressure refrigerant and discharges high-pressure refrigerant. For example, a reciprocating compressor, a rotary compressor, or a scroll compressor is used as the compressor 1. Further, the compressor 1 may be a vertical compressor or a horizontal compressor.

The refrigerant flow switching device 2 is a switching device configured to switch refrigerant flow paths inside the refrigerant flow switching device 2 to switch the cooling operation to heating operation of the air-conditioning apparatus 100 and to switch the heating operation to the cooling operation of the air-conditioning apparatus 100. The refrigerant flow switching device 2 includes a first port 2*a*, a second port 2*b*, a third port 2*c*, and a fourth port 2*d* each communicating with the refrigerant flow path inside the refrigerant flow switching device 2. The first port 2*a* communicates with a discharge port of the compressor 1 by pipe. The second port 2*b* communicates with the heat source-side heat exchanger 3 by pipe. The third port 2*c* communicates with the load-side heat exchanger 5 by pipe. The fourth port 2*d* communicates with a suction port of the compressor 1 by pipe. The refrigerant flow switching device 2 is, for example, a four-way valve to which operation of a solenoid valve is applied. The refrigerant flow switching device 2 may include a two-way valve or a three-way valve in combination.

In the following description, the "cooling operation" refers to an operation state of the air-conditioning apparatus 100 that causes the low-pressure refrigerant flowing out from the load-side heat exchanger 5 to be suctioned into the compressor 1. The "heating operation" refers to an operation state of the air-conditioning apparatus 100 that causes the high-pressure refrigerant discharged from the compressor 1 to flow into the load-side heat exchanger 5.

The heat source-side heat exchanger 3 is a heat transfer device that transfers and exchanges heat energy between two fluids having different heat energies. The heat source-side heat exchanger 3 is used as a condenser during the cooling operation and is used as an evaporator during the heating operation. The heat source-side heat exchanger 3 illustrated in FIG. 1 is an air-cooled heat exchanger exchanging heat between an air flow passing through the heat source-side heat exchanger 3 and the high-pressure refrigerant flowing through the inside of the heat source-side heat exchanger 3. The heat source-side heat exchanger 3 may be, for example, a fin-and-tube heat exchanger or a plate fin heat exchanger depending on an application of the air-conditioning apparatus 100. Note that, in the air-conditioning apparatus 100, the evaporator is referred to as a cooler and the condenser is referred to as a radiator in some cases.

The air flow passing through the heat source-side heat exchanger 3 is generated by a heat source-side air-sending device 3*a*. The heat source-side air-sending device 3*a* may be a propeller fan or other axial flow fan, a sirocco fan, a turbo fan, or other centrifugal fan, a diagonal flow fan, a transverse flow fan, or other fans depending on an application of the heat source-side heat exchanger 3.

Alternatively, the heat source-side heat exchanger 3 may be a water-cooled heat exchanger exchanging heat between a heat medium passing through the heat source-side heat exchanger 3 and the high-pressure refrigerant passing through the heat source-side heat exchanger 3, depending on the application of the air-conditioning apparatus 100. In a case where the heat source-side heat exchanger 3 is the water-cooled heat exchanger, the air-conditioning apparatus 100 may not include the heat source-side air-sending device 3*a*. In the case where the heat source-side heat exchanger 3 is the water-cooled heat exchanger, the heat source-side heat exchanger 3 may be a shell-and-tube heat exchanger, a plate heat exchanger, or a double pipe heat exchanger depending on a form or the application of the air-conditioning apparatus 100. In the case where the heat source-side heat exchanger 3 is the water-cooled heat exchanger, the air-conditioning apparatus 100 may include a heat medium circuit circulating the heat medium from a cooling tower.

The decompression device 4 is an expansion device that expands and decompresses high-pressure liquid-phase refrigerant. As the decompression device 4, an expansion machine, an automatic thermal expansion valve, a linear electronic expansion valve, or another similar component is used depending on the application of the air-conditioning apparatus 100. The expansion machine is a mechanical expansion valve to which a diaphragm is applied in a pressure receiving unit. The automatic thermal expansion valve is an expansion device adjusting a refrigerant amount on the basis of a degree of superheat of gas-phase refrigerant at the suction port of the compressor 1. The linear electronic expansion valve is an expansion device configured to adjust the opening degree stepwise or continuously.

The load-side heat exchanger 5 is a heat transfer device that transfers and exchanges heat energy between two fluids having different heat energies. The load-side heat exchanger 5 is used as an evaporator during the cooling operation and is used as a condenser during the heating operation. The load-side heat exchanger 5 is an air-cooled heat exchanger exchanging heat between an air flow passing through the load-side heat exchanger 5 and the refrigerant flowing through the inside of the load-side heat exchanger 5. The load-side heat exchanger 5 is a fin-and-tube heat exchanger that includes a plurality of fins arranged in parallel to each other and a heat transfer tube penetrating through the plurality of fins.

The air flow passing through the load-side heat exchanger 5 is generated by an air-sending device 5*a*. The air-sending device 5*a* may be a propeller fan or other axial flow fan, a sirocco fan, a turbo fan, or other centrifugal fan, a diagonal flow fan, a transverse flow fan, or other fans depending on a form of the load-side heat exchanger 5.

The air-conditioning apparatus 100 includes the plurality of refrigerant pipes that connect the compressor 1, the refrigerant flow switching device 2, the heat source-side heat exchanger 3, the decompression device 4, and the load-side heat exchanger 5 to form the refrigerant circuit 10. The refrigerant pipes included in the refrigerant circuit 10 include a first refrigerant pipe 10*a*, a second refrigerant pipe 10*b*, a third refrigerant pipe 10*c*, a fourth refrigerant pipe 10*d*, a fifth refrigerant pipe 10*e*, and a sixth refrigerant pipe 10*f*. The first refrigerant pipe 10*a* connects the decompression device 4 and the load-side heat exchanger 5. The second refrigerant pipe 10*b* connects the load-side heat exchanger 5 and the third port 2*c* of the refrigerant flow switching device 2. The third refrigerant pipe 10*c* connects the fourth port 2*d* of the refrigerant flow switching device 2 and the suction port of the compressor 1. The fourth refrigerant pipe 10*d* connects the discharge port of the compressor 1 and the first port 2*a* of the refrigerant flow switching device 2. The fifth refrigerant pipe 10*e* connects the second port 2*b* of the refrigerant flow switching device 2 and the heat source-side heat exchanger 3. The sixth refrigerant pipe 10*f* connects the heat source-side heat exchanger 3 and the decompression device 4. The second refrigerant pipe 10*b* is connected to the compressor 1 through the refrigerant flow switching device 2 and any of the third refrigerant pipe 10*c* and the fourth refrigerant pipe 10*d*. In other words, the second refrigerant pipe 10*b* connects the compressor 1 and the load-side heat exchanger 5. In the following description, in a case where it is unnecessary to distinguish the first refrigerant pipe 10*a*, the second refrigerant pipe 10*b*, the third refrigerant pipe 10*c*, the fourth refrigerant pipe 10*d*, the fifth refrigerant pipe 10*e*, and the sixth refrigerant pipe 10*f* from one another, these pipes are simply referred to as the "refrigerant pipes".

The air-conditioning apparatus 100 may include devices other than the above-described devices, for example, an accumulator, a receiver, a silencing muffler, a gas-liquid separator, and an oil separator, depending on the application of the air-conditioning apparatus 100. Further, the air-conditioning apparatus 100 may be designed as an indoor stationary integrated air-conditioning apparatus or as a separate air-conditioning apparatus in which only some of the devices including the load-side heat exchanger 5 are installed in an air-conditioned space.

Next, a configuration of the load-side heat exchanger 5 in the air-conditioning apparatus 100 of Embodiment 1 will be specifically described with reference to FIG. 2 and FIG. 3 in addition to FIG. 1, Outlined block arrows illustrated in FIG. 2 and FIG. 3 each indicate a flow direction of the air flow generated by the air-sending device 5*a* or the heat source-side air-sending device 3*a*. Further, black arrows illustrated in FIG. 2 and FIG. 3 schematically indicate an inflow direction and an outflow direction of the refrigerant in the load-side heat exchanger 5 during the cooling operation of the air-conditioning apparatus 100.

Figure 2:
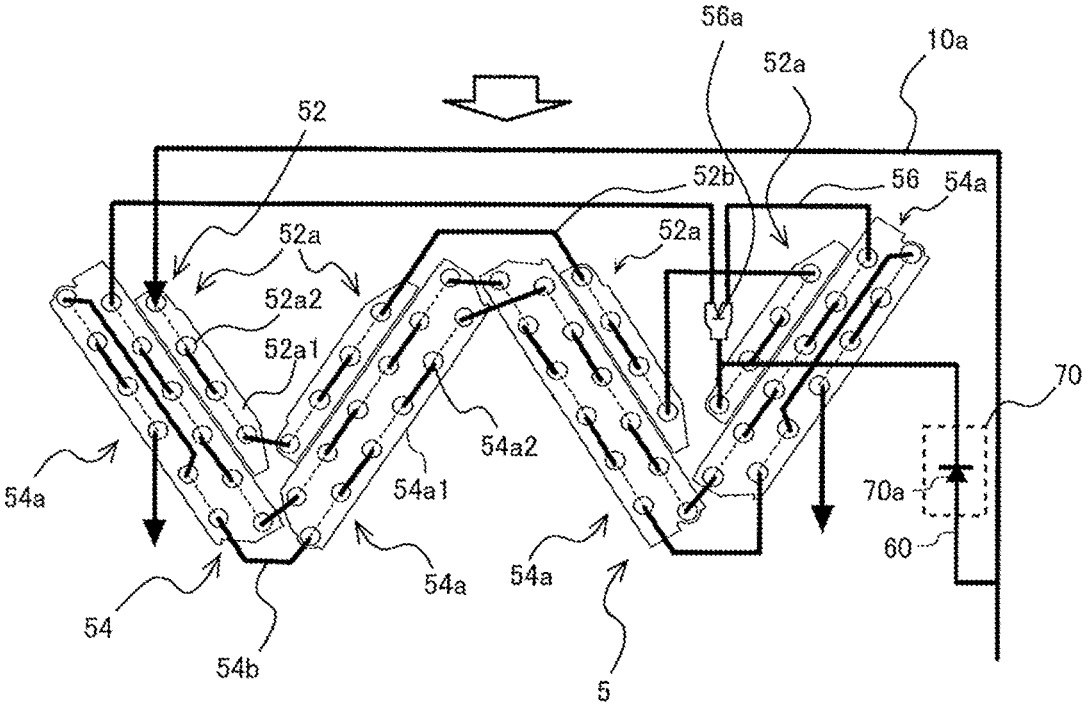
FIG. 2 is a schematic diagram illustrating an example of a specific configuration of a load-side heat exchanger in the air-conditioning apparatus of Embodiment 1 of the present disclosure.
Figure 3:
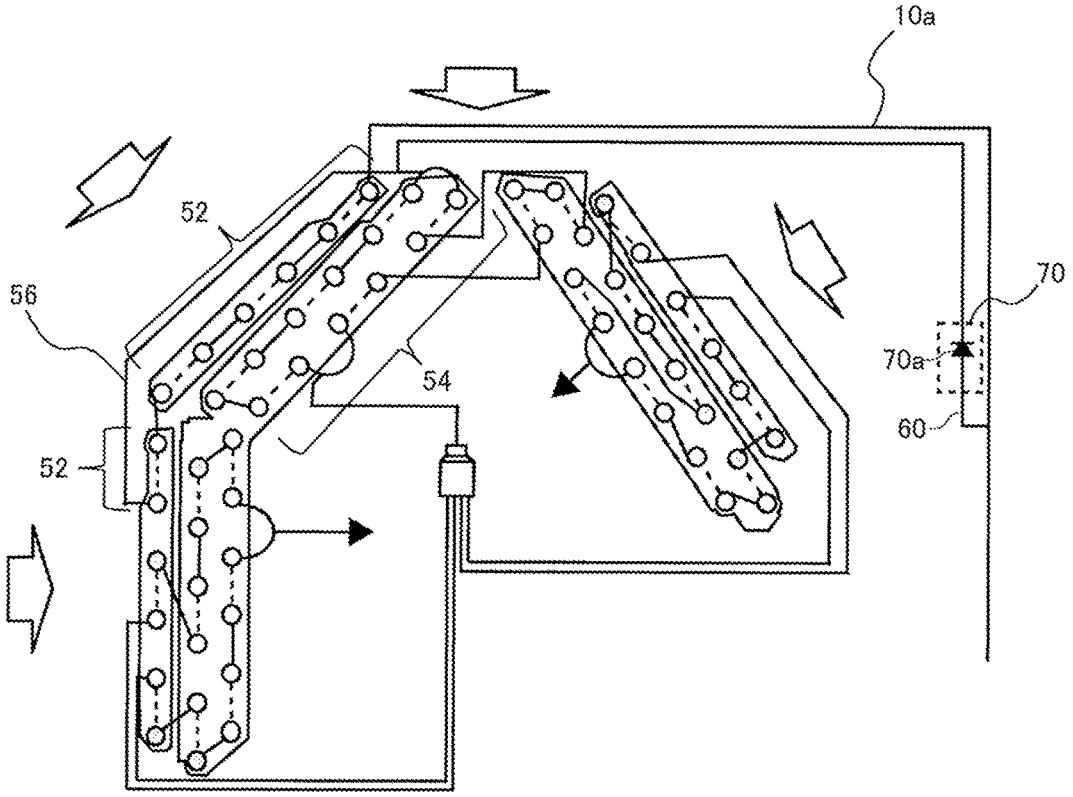
FIG. 3 is a schematic diagram illustrating another example of the specific configuration of the load-side heat exchanger in the air-conditioning apparatus of Embodiment 1 of the present disclosure.

FIG. 2 is a schematic diagram illustrating an example of the specific configuration of the load-side heat exchanger 5 in the air-conditioning apparatus 100 of Embodiment 1. FIG. 3 is a schematic diagram illustrating another example of the specific configuration of the load-side heat exchanger 5 in the air-conditioning apparatus 100 of Embodiment 1.

As illustrated in FIG. 1, the load-side heat exchanger 5 includes a first heat exchanger 52 and a second heat exchanger 54. The first heat exchanger 52 is disposed on windward in the direction of the air flow generated by the air-sending device 5*a*. The second heat exchanger 54 is disposed on leeward in a direction of the air flow passing through the first heat exchanger 52. The air-sending device 5*a* illustrated in FIG. 1 is disposed to face the first heat exchanger 52; however, a position of the air-sending device 5*a* is not limited to the position illustrated in FIG. 1. The air-sending device 5*a* illustrated in FIG. 1 may be disposed at a position different from the position of the air-sending device 5*a* illustrated in FIG. 1 as long as the air-sending device 5*a* is allowed to send air such that the first heat exchanger 52 is positioned on the windward of the second heat exchanger 54. The first heat exchanger 52 is also referred to as an "auxiliary heat exchanger", and the second heat exchanger 54 is also referred to as a "main heat exchanger".

Further, in FIG. 1, the first heat exchanger 52 includes one first internal flow path 52*b*, and the second heat exchanger 54 includes two second internal flow paths 54*b*. However, the number of first internal flow paths 52*b* and the number of second internal flow paths 54*b* are not limited to the numbers illustrated in FIG. 1.

In the load-side heat exchanger 5, a coupling pipe 56 connects the first heat exchanger 52 and the second heat exchanger 54. In other words, the second heat exchanger 54 is connected in series with the first heat exchanger 52 through the coupling pipe 56. The coupling pipe 56 is one of the refrigerant pipes included in the refrigerant circuit 10. The first refrigerant pipe 10*a* that connects the decompression device 4 and the load-side heat exchanger 5 is connected to the decompression device 4 and the first heat exchanger 52. The compressor 1 is connected to the second heat exchanger 54 of the load-side heat exchanger 5 by the second refrigerant pipe 10*b* and the third refrigerant pipe 10*c* through the refrigerant flow switching device 2.

In FIG. 2, the first heat exchanger 52 includes four first heat exchange units 52*a* arranged in a W-shape. The second heat exchanger 54 includes four second heat exchange units 54*a* that are connected in series with the four first heat exchange units 52*a* of the first heat exchanger 52, and are arranged in a W-shape as with the first heat exchanger 52. The first heat exchange units 52*a* of the first heat exchanger 52 are disposed on the windward in the direction of the air flow generated by the air-sending device 5*a*. The second heat exchange units 54*a* of the second heat exchanger 54 are disposed on the leeward in the direction of the air flow that is generated by the air-sending device 5*a* and passes through the first heat exchange units 52*a* of the first heat exchanger 52.

Each of the first heat exchange units 52*a* is a fin-and-tube heat exchanger including a plurality of first fins 52*a*1 arranged in parallel to each other and a first heat transfer tube 52*a*2 penetrating through the plurality of first fins 52*a*1. Each of the second heat exchange units 54*a* is a fin-and-tube heat exchanger including a plurality of second fins 54*a*1 arranged in parallel to each other and a second heat transfer tube 54*a*2 penetrating through the plurality of second fins 54*a*1. Each of the first heat transfer tubes 52*a*2 and the second heat transfer tubes 54*a*2 is a circular tube as illustrated in FIG. 2; however, each of the first heat transfer tubes 52*a*2 and the second heat transfer tubes 54*a*2 may be a flat tube.

The coupling pipe 56 connecting the first heat exchanger 52 and the second heat exchanger 54 includes a branch portion 56*a*. As the coupling pipe 56 includes the branch portion 56*a*, the first internal flow path 52*b* of the first heat exchanger 52 is branched such that the first internal flow path 52*b* is formed to communicate with each of the second internal flow paths 54*b* of the second heat exchanger 54. In FIG. 2, the first heat exchanger 52 includes one first internal flow path 52*b*, and the second heat exchanger 54 includes two second internal flow paths 54*b* as illustrated in FIG. 1; however, the number of first internal flow paths 52*b* and the number of second internal flow paths 54*b* are not limited to the numbers illustrated in FIG. 1 and FIG. 2 as described above.

In the load-side heat exchanger 5 illustrated in FIG. 3, the first heat exchanger 52 is disposed only in an air flow path of the air flow from upper left. The first heat exchanger 52 is disposed on the windward of the second heat exchanger 54 in a direction of the air flow generated by the air-sending device 5*a*. The second heat exchanger 54 is connected in series with the first heat exchanger 52. A part of the second heat exchanger 54 is disposed on the leeward in the direction of the air flow that is generated by the air-sending device 5*a* and passes through the first heat exchanger 52. As described above, the first heat exchanger 52 may be disposed on only a part of the air flow path through the load-side heat exchanger 5 as long as the first heat exchanger 52 is disposed on the windward in the direction of the air flow that is generated by the air-sending device 5*a* and passes through the first heat exchanger 52 and the second heat exchanger 54.

In FIG. 1 to FIG. 3, the first heat exchanger 52 and the second heat exchanger 54 are heat exchangers separated from each other. Alternatively, an integrated load-side heat exchanger 5 may be used in which the first fins 52*a*1 of the first heat exchanger 52 and the second fins 54*a*1 of the second heat exchanger 54 are integrally formed.

Next, a bypass structure in the air-conditioning apparatus 100 will be described.

As illustrated in FIG. 1 to FIG. 3, the air-conditioning apparatus 100 includes a bypass pipe 60 and a bypass valve 70. The bypass pipe 60 is the refrigerant pipe connecting the coupling pipe 56 and the first refrigerant pipe 10*a* that connects the decompression device 4 and the first heat exchanger 52, and is one of the refrigerant pipes included in the refrigerant circuit 10. The bypass pipe 60 includes a first bypass pipe 60*a* connecting the first refrigerant pipe 10*a* and the bypass valve 70, and a second bypass pipe 60*b* connecting the bypass valve 70 and the coupling pipe 56. In the following description, in a case where it is unnecessary to distinguish the first bypass pipe 60*a* and the second bypass pipe 60*b* from each other, the first bypass pipe 60*a* and the second bypass pipe 60*b* are simply referred to as the bypass pipe 60.

The bypass valve 70 is a control device controlling a flow rate of the refrigerant in the bypass pipe 60. During the cooling operation, the bypass valve 70 allows the refrigerant flowing from the first refrigerant pipe 10*a* toward the coupling pipe 56 of the load-side heat exchanger 5 through the bypass pipe 60 to pass through the bypass pipe 60. In contrast, during the heating operation, the bypass valve 70 blocks the flow of the refrigerant flowing from the coupling pipe 56 of the load-side heat exchanger 5 toward the first refrigerant pipe 10*a* through the bypass pipe 60. In other words, during the cooling operation, the bypass valve 70 opens the flow path inside the bypass pipe 60. Therefore, the refrigerant circuit 10 includes a bypass connecting both ends of the first heat exchanger 52. In contrast, during the heating operation, the bypass valve 70 closes the flow path inside the bypass pipe 60. Therefore, the refrigerant circuit 10 does not include the bypass connecting both ends of the first heat exchanger 52.

The bypass valve 70 may include an automatic valve, for example, a mechanical valve such as a pressure driven valve or an electric-operated valve such as a solenoid valve. As illustrated in FIG. 1 to FIG. 3, the bypass valve 70 may include a check valve 70*a* as the pressure driven automatic valve. The check valve 70*a* is a mechanical valve that maintains the flow of the fluid in a fixed direction to prevent backflow.

In a case where the air-conditioning apparatus 100 is a separate air-conditioning apparatus, the air-conditioning apparatus 100 may include an indoor unit 150 that houses the load-side heat exchanger 5, the air-sending device 5*a*, the bypass pipe 60, and the bypass valve 70.

Next, operation during the cooling operation of the air-conditioning apparatus 100 will be described with reference to FIG. 1. In FIG. 1, the refrigerant flow path inside the refrigerant flow switching device 2 during the cooling operation is illustrated by a solid line.

During the cooling operation, the refrigerant flow path inside the refrigerant flow switching device 2 is controlled to cause high-temperature and high-pressure gas refrigerant to flow from the compressor 1 to the heat source-side heat exchanger 3. In other words, during the cooling operation, the refrigerant flow path inside the refrigerant flow switching device 2 is switched such that the first port 2*a* connected to the discharge port of the compressor 1 by pipe and the second port 2*b* connected to the heat source-side heat exchanger 3 by pipe communicate with each other. Further, the refrigerant flow path inside the refrigerant flow switching device 2 is switched such that the third port 2*c* connected to the load-side heat exchanger 5 by pipe and the fourth port 2*d* connected to the suction port of the compressor 1 by pipe communicate with each other.

The high-temperature and high-pressure gas-phase refrigerant discharged from the compressor 1 flows into the heat source-side heat exchanger 3 through the fourth refrigerant pipe 10*d*, the refrigerant flow path between the first port 2*a* and the second port 2*b* inside the refrigerant flow switching device 2, and the fifth refrigerant pipe 10*e*. During the cooling operation, the heat source-side heat exchanger 3 is used as a condenser. The high-temperature and high-pressure gas-phase refrigerant flowing into the heat source-side heat exchanger 3 exchanges heat with the air flow that is generated by the heat source-side air-sending device 3*a* and passes through the heat source-side heat exchanger 3. Subsequently, the resultant high-pressure liquid-phase refrigerant flows out.

The high-pressure liquid-phase refrigerant flowing out from the heat source-side heat exchanger 3 flows into the decompression device 4 through the sixth refrigerant pipe 10*f*. The high-pressure liquid-phase refrigerant flowing into the decompression device 4 is expanded and decompressed by the decompression device 4. Subsequently, the resultant low-temperature and low-pressure two-phase refrigerant flows out from the decompression device 4 and flows into the first refrigerant pipe 10*a*. During the cooling operation, the flow path inside the bypass pipe 60 is opened by the bypass valve 70. Therefore, the low-pressure two-phase refrigerant flowing into the first refrigerant pipe 10*a* is divided, and one of divided parts of the low-pressure two-phase refrigerant flows into the bypass pipe 60, and flows into the coupling pipe 56 through the bypass valve 70.

The other one of the divided parts of the low-temperature and low-pressure two-phase refrigerant flows into the first heat exchanger 52 of the load-side heat exchanger 5 through the first refrigerant pipe 10*a* During the cooling operation, the first heat exchanger 52 is used as an evaporator. The low-pressure two-phase refrigerant flowing into the first heat exchanger 52 exchanges heat with the air flow that is generated by the air-sending device 5*a* and passes through the first heat exchanger 52. Subsequently, the resultant two-phase refrigerant flows out to the coupling pipe 56.

The two-phase refrigerant flowing into the coupling pipe 56 is merged again with the two-phase refrigerant divided from the refrigerant in the first refrigerant pipe 10*a*, and the resultant refrigerant flows into the second heat exchanger 54. During the cooling operation, the second heat exchanger 54 is used as an evaporator. The low-pressure two-phase refrigerant flowing into the second heat exchanger 54 exchanges heat with the air flow passing through the second heat exchanger 54. Subsequently, the resultant low-pressure gas-phase refrigerant flows out.

The low-pressure gas-phase refrigerant flowing out from the second heat exchanger 54 is suctioned into the compressor 1 through the second refrigerant pipe 10*b*, the refrigerant flow path between the third port 2*c* and the fourth port 2*d* inside the refrigerant flow switching device 2, and the third refrigerant pipe 10*c*. The low-pressure gas-phase refrigerant suctioned into the compressor 1 is compressed by the compressor 1. Subsequently, the resultant high-temperature and high-pressure gas-phase refrigerant is discharged from the compressor 1. During the cooling operation of the air-conditioning apparatus 100, the above-described cycle is repeated.

Next, effects by the air-conditioning apparatus 100 during the cooling operation will be described.

In the case of the cooling operation in which the load-side heat exchanger 5 is used as an evaporator, the refrigerant flowing through the internal flow path through the load-side heat exchanger 5 is large in specific volume and is high in flow speed. Therefore, pressure loss of the refrigerant is large. For example, in the case of a configuration in which the first internal flow paths 52*b* of the first heat exchanger 52 are smaller in number than the second internal flow paths 54*b* of the second heat exchanger 54, the flow speed of the refrigerant passing through the first internal flow path 52*b* is higher than the flow speed of the refrigerant passing through the second internal flow paths 54*b*. When the flow speed of the refrigerant in the internal flow path is increased, the refrigerant pressure loss in the internal flow path is increased. Therefore, in the first heat exchanger 52, the refrigerant pressure loss is easily generated. However, as the low-temperature and low-pressure two-phase refrigerant flowing through the first refrigerant pipe 10*a* is divided, and one of divided parts of the low-temperature and low-pressure two-phase refrigerant flows into the bypass pipe 60, it is possible to reduce the flow rate of the refrigerant flowing into the first heat exchanger 52. When the flow rate of the refrigerant flowing into the first heat exchanger 52 is reduced, the refrigerant pressure loss in the first heat exchanger 52 is reduced, so that the cooling performance of the first heat exchanger 52 is improved.

All refrigerant flowing out from the decompression device 4 is divided into the flow path passing through the bypass pipe 60 and the bypass valve 70 and the flow path through which a part of the refrigerant flows into the first heat exchanger 52. As a result, the refrigerant pressure loss in the first heat exchanger 52 is reduced. In contrast, if the flow rate of the refrigerant flowing through the first heat exchanger 52 is excessively reduced, a heat exchange amount at the first heat exchanger 52 may be reduced, and the improving effect of the cooling performance obtained by reduction of the refrigerant pressure loss may be canceled. The flow rate of the refrigerant bypassed to the flow path passing through the bypass pipe 60 and the bypass valve 70 that is improved to the extent possible is thus determined on the basis of the cooling capacity to be exerted by the load-side heat exchanger 5 or the total flow rate of the refrigerant. The bypass valve 70 may have a specification in which the flow rate becomes the flow rate that is improved to the extent possible when the bypass valve 70 is opened, or a specification in which the flow rate is set to the flow rate that is improved to the extent possible by adjustment of the opening degree of the bypass valve 70.

Further, during the cooling operation, the first heat exchanger 52 and the second heat exchanger 54 are connected in series through the coupling pipe 56. In addition, the second heat exchanger 54 is disposed downstream in the direction of the air flow that is generated by the air-sending device 5*a* and passes through the first heat exchanger 52. Further, at least the second heat exchanger 54 is disposed over an entire region of the air flow path through which the air flow generated by the air-sending device 5*a* flows. Whether the refrigerant dries out at the outlet of the load-side heat exchanger 5 thus depends only on distribution of the heat exchange amount of each of the refrigerant flow paths in the second heat exchanger 54, and does not relate to distribution of the heat exchange amount in the first heat exchanger 52. For example, in the air-conditioning apparatus 100, even when the specification of the first heat exchanger 52 or the second heat exchanger 54, for example, a pitch width of the fins or the number of fins, or the number of heat transfer tubes is optionally set, the refrigerant does not dry out because of difference in heat load between the first heat exchanger 52 and the second heat exchanger 54. In the air-conditioning apparatus 100, a degree of freedom in design change of the first heat exchanger 52 and the second heat exchanger 54 is thus secured, so that the air-conditioning apparatus 100 having a high degree of freedom in design is provided.

Figure 4:
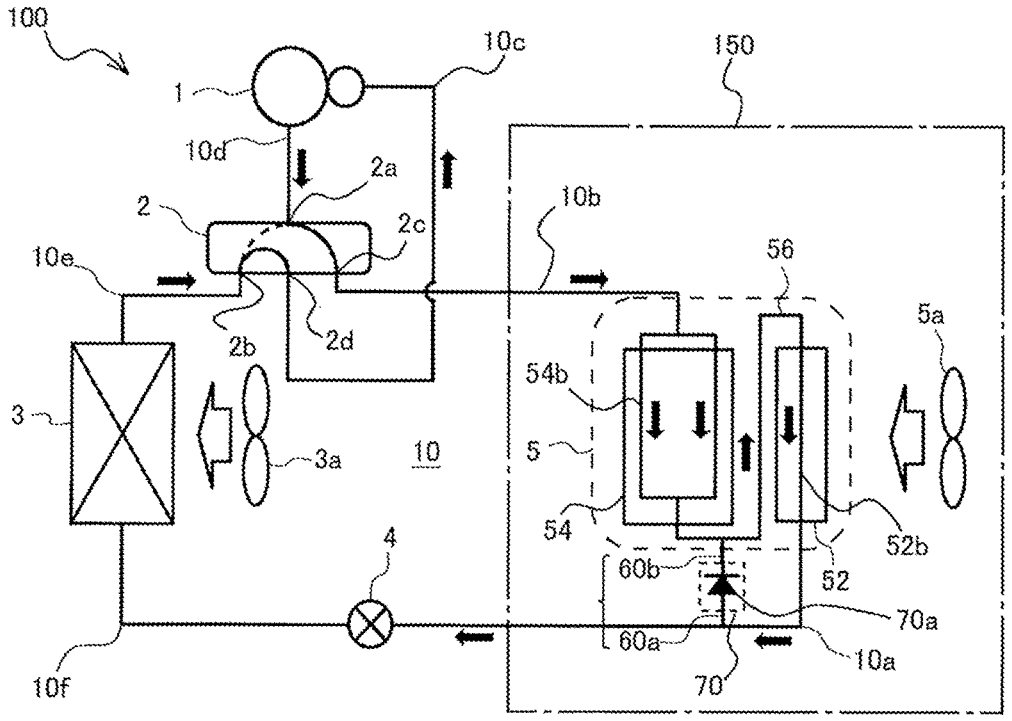
FIG. 4 is a schematic refrigerant circuit diagram illustrating an example of the refrigerant circuit during heating operation of the air-conditioning apparatus according to Embodiment 1 of the present disclosure.

Next, operation during the heating operation of the air-conditioning apparatus 100 will be described with reference to FIG. 4. FIG. 4 is a schematic refrigerant circuit diagram illustrating an example of the refrigerant circuit 10 during the heating operation of the air-conditioning apparatus 100 according to Embodiment 1. Black arrows illustrated in FIG. 4 each indicate a flow direction of the refrigerant during the cooling operation. Further, outlined block arrows illustrated in FIG. 4 each indicate a flow direction of the air flow. In FIG. 4, the refrigerant flow path inside the refrigerant flow switching device 2 during the heating operation is illustrated by a solid line. As illustrated in FIG. 4, in the air-conditioning apparatus 100, the direction of the flow of the refrigerant flowing through the internal flow paths of the load-side heat exchanger 5 during the heating operation is opposite to the direction of the flow of the refrigerant during the cooling operation.

During the heating operation, the refrigerant flow path inside the refrigerant flow switching device 2 is controlled to cause high-temperature and high-pressure gas refrigerant to flow from the compressor 1 to the load-side heat exchanger 5. In other words, during the heating operation, the refrigerant flow path inside the refrigerant flow switching device 2 is switched such that the first port 2*a* connected to the discharge port of the compressor 1 by pipe and the third port 2*c* connected to the load-side heat exchanger 5 by pipe communicate with each other. Further, the refrigerant flow path inside the refrigerant flow switching device 2 is switched such that the second port 2*b* connected to the heat source-side heat exchanger 3 by pipe and the fourth port 2*d* connected to the suction port of the compressor 1 by pipe communicate with each other.

The high-temperature and high-pressure gas-phase refrigerant discharged from the compressor 1 flows into the second heat exchanger 54 of the load-side heat exchanger 5 through the fourth refrigerant pipe 10*d*, the refrigerant flow path between the first port 2*a* and the third port 2*c* inside the refrigerant flow switching device 2, and the third refrigerant pipe 10*c*. During the heating operation, the second heat exchanger 54 is used as a condenser. The high-temperature and high-pressure gas-phase refrigerant flowing into the second heat exchanger 54 exchanges heat with the air flow that is generated by the air-sending device 5*a* and passes through the second heat exchanger 54, and then flows out from the second heat exchanger 54.

The refrigerant flowing out from the second heat exchanger 54 flows into the first heat exchanger 52 through the coupling pipe 56. During the heating operation, the bypass valve 70 closes the flow path inside the bypass pipe 60. Therefore, the refrigerant flowing into the coupling pipe 56 all flows into the first heat exchanger 52 without being divided and flowing into the bypass pipe 60.

During the heating operation, the first heat exchanger 52 is used as a subcooling heat exchanger. The refrigerant flowing into the first heat exchanger 52 exchanges heat with the air flow that is generated by the air-sending device 5*a* and passes through the first heat exchanger 52. Subsequently, the resultant subcooled high-pressure liquid-phase refrigerant flows out.

The subcooled high-pressure liquid-phase refrigerant flows into the decompression device 4 through the first refrigerant pipe 10*a*. The subcooled high-pressure gas-phase refrigerant flowing into the decompression device 4 is expanded and decompressed by the decompression device 4. Subsequently, the resultant low-temperature and low-pressure two-phase refrigerant flows out from the decompression device 4.

The low-temperature and low-pressure two-phase refrigerant flowing out from the decompression device 4 flows into the heat source-side heat exchanger 3 through the sixth refrigerant pipe 10*f*. During the heating operation, the heat source-side heat exchanger 3 is used as an evaporator. The low-temperature and low-pressure two-phase refrigerant flowing into the heat source-side heat exchanger 3 exchanges heat with the air flow that is generated by the heat source-side air-sending device 3*a* and passes through the heat source-side heat exchanger 3. Subsequently, the resultant low-pressure gas-phase refrigerant flows out. Note that the refrigerant flowing out from the heat source-side heat exchanger 3 becomes low-pressure two-phase refrigerant that is high in quality in some cases.

The low-pressure gas-phase refrigerant flowing out from the heat source-side heat exchanger 3 is suctioned into the compressor 1 through the fifth refrigerant pipe 10*e*, the refrigerant flow path between the second port 2*b* and the fourth port 2*d* inside the refrigerant flow switching device 2, and the fourth refrigerant pipe 10*d*. The low-pressure gas-phase refrigerant suctioned into the compressor 1 is compressed by the compressor 1. Subsequently, the resultant high-temperature and high-pressure gas-phase refrigerant is discharged from the compressor 1. During the heating operation of the air-conditioning apparatus 100, the above-described cycle is repeated.

Next, effects by the air-conditioning apparatus 100 during the heating operation will be described.

In a case where the number of internal flow paths provided in parallel to each other inside the load-side heat exchanger 5 is increased during the heating operation in which the load-side heat exchanger 5 is used as a condenser, the flow speed of the refrigerant in each of the internal flow paths of the load-side heat exchanger 5 is lowered. When the flow speed of the refrigerant in each of the internal flow paths of the load-side heat exchanger 5 is lowered, an in-pipe heat transfer coefficient of the load-side heat exchanger 5 is lowered. However, in the load-side heat exchanger 5 during the heating operation, the first heat exchanger 52 is connected in series with the second heat exchanger 54 such that the first heat exchanger 52 is positioned downstream of the second heat exchanger 54, and is not connected in parallel to the second heat exchanger 54. Therefore, the number of internal flow paths provided in parallel to each other is not increased inside the load-side heat exchanger 5. During the heating operation, the number of internal flow paths provided in parallel to each other inside the load-side heat exchanger 5 is not thus increased, and lowering of the flow speed of the refrigerant in each of the internal flow paths of the load-side heat exchanger 5 is prevented. This configuration makes it possible to maintain the in-pipe heat transfer coefficient of the load-side heat exchanger 5.

Further, during the heating operation, the bypass valve 70 closes the flow path inside the bypass pipe 60. Therefore, the high-pressure refrigerant flowing into the coupling pipe 56 all flows into the first heat exchanger 52, and the flow speed is accordingly increased. This configuration makes it possible to enhance a heat transfer coefficient of the first heat transfer tube 52*a*2. In contrast, the refrigerant passing through the first heat exchanger 52 is the high-pressure and high-density refrigerant, and the refrigerant pressure loss is small. Therefore, influence of pressure loss caused by increase in the flow speed of the refrigerant is ignorable. In the air-conditioning apparatus 100, the flow path inside the bypass pipe 60 is thus closed during the heating operation, so that heating performance is enhanced.

As described above, as the air-conditioning apparatus 100 includes the bypass pipe 60 and the bypass valve 70, the pressure loss is reduced and the cooling performance of the load-side heat exchanger 5 is improved during the cooling operation. In addition, during the heating operation, as the first heat exchanger 52 is connected in series with the second heat exchanger 54, the flow speed of the refrigerant flowing through the second heat exchanger 54 is increased, so that the in-pipe heat transfer coefficient is enhanced. Therefore, in the air-conditioning apparatus 100, the relationship between the refrigerant pressure loss and the heat transfer performance of the load-side heat exchanger 5 is improved to the extent possible during the cooling operation and during the heating operation. This configuration makes it possible to reduce energy consumption all year round.

Further, in the air-conditioning apparatus 100, the energy consumption can be reduced by a simple configuration in which the bypass pipe 60 is connected to both ends of the first heat exchanger 52, and the bypass valve 70 is provided in the bypass pipe 60. It is thus possible to downsize the air-conditioning apparatus 100 while maintaining performance of the air-conditioning apparatus 100. In addition, the design of the first heat exchanger 52 and the second heat exchanger 54, for example, a dimension of each of the heat exchangers, a heat transfer area of each of the fins, the number of heat transfer tubes, a diameter of the heat transfer tube, an inner groove shape of the heat transfer tube, and the number of refrigerant flow paths of each of the heat exchangers are changeable in an optional combination. Therefore, in the air-conditioning apparatus 100, the degree of freedom in design change of the load-side heat exchanger 5 is secured. It is thus possible to reduce the energy consumption by the air-conditioning apparatus 100 and to downsize the air-conditioning apparatus 100, and high quality of the air-conditioning apparatus 100 is maintained.

For example, a case is considered where it is necessary to prevent the refrigerant from drying out in the second heat exchanger 54 during the cooling operation. First, a case where, unlike Embodiment 1, the first heat exchanger 52 and the second heat exchanger 54 of the load-side heat exchanger 5 are arranged in parallel to a direction in which air passes through the load-side heat exchanger 5, is considered. In this case, to prevent the refrigerant from drying out in the second heat exchanger 54, it is necessary to constantly consider a heat load relationship with the first heat exchanger 52. For example, as a method of preventing the refrigerant from drying out in the second heat exchanger 54, a method works in which the heat transfer area of the second heat exchanger 54 is designed to be smaller than the heat transfer area of the first heat exchanger 52, and a method works in which the flow rate of the refrigerant distributed to the second heat exchanger 54 is specified to be larger than the flow rate of the refrigerant distributed to the first heat exchanger 52 by using a flow control valve. Next, the air-conditioning apparatus 100 of Embodiment 1 will be considered. In the air-conditioning apparatus 100 of Embodiment 1, during the cooling operation, the first heat exchanger 52 and the second heat exchanger 54 are connected in series through the coupling pipe 56. Further, the second heat exchanger 54 is disposed downstream in the direction of the air flow that is generated by the air-sending device 5*a* and passes through the first heat exchanger 52.

Further, at least the second heat exchanger 54 is disposed over the entire region of the air flow path through which the air flow generated by the air-sending device 5*a* flows. Therefore, in the air-conditioning apparatus 100 of Embodiment 1, whether the refrigerant dries out in the second heat exchanger 54 does not depend on the state such as the heat exchange amount of the refrigerant in the first heat exchanger 52, so that independent redesign of only the second heat exchanger 54 is available. In the air-conditioning apparatus 100 of Embodiment 1, the degree of freedom in design change of the load-side heat exchanger 5 is thus secured. In addition, means for improving the performance and the quality of an optional heat exchanger may be independently or selectively added to the first heat exchanger 52 or the second heat exchanger 54. In a case where the air-conditioning apparatus 100 of Embodiment 1 is a separate air-conditioning apparatus including the indoor unit 150, a simple configuration may be used in which the load-side heat exchanger 5, the air-sending device 5*a*, the bypass pipe 60, and the bypass valve 70 are housed in the indoor unit 150, It is thus possible to facilitate installation, in an installation space, of the indoor unit 150 that may be limited in an installation condition such as an installation dimension.

Embodiment 2

Figure 5:
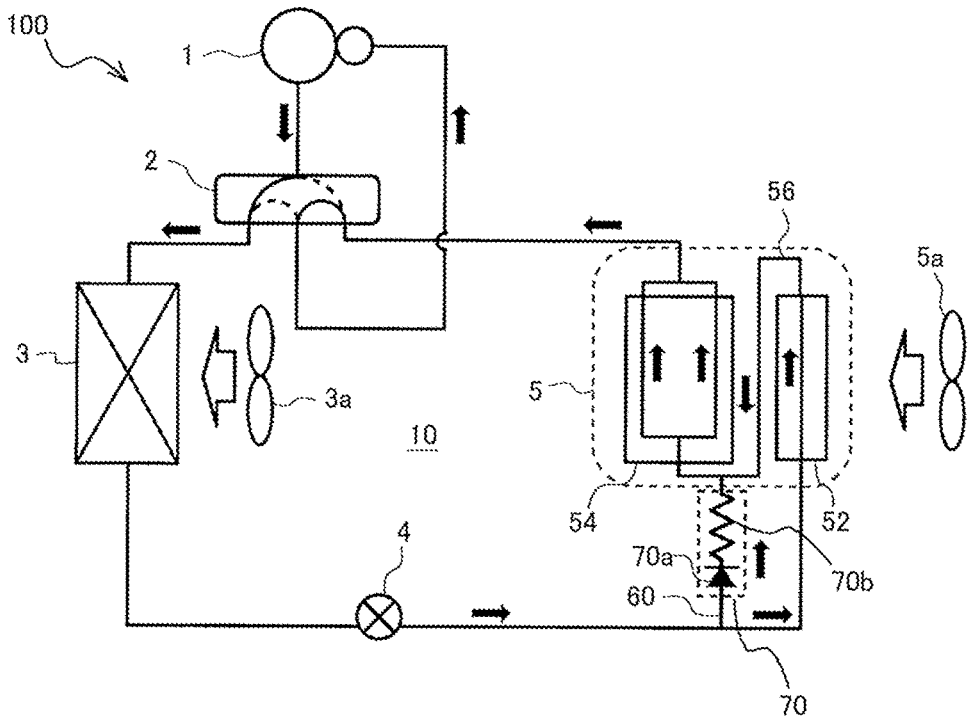
FIG. 5 is a schematic refrigerant circuit diagram illustrating an example of a refrigerant circuit during cooling operation of an air-conditioning apparatus according to Embodiment 2 of the present disclosure.

A configuration of the air-conditioning apparatus 100 of Embodiment 2 of the present disclosure will be described with reference to FIG. 5. FIG. 5 is a schematic refrigerant circuit diagram illustrating an example of the refrigerant circuit 10 during the cooling operation of the air-conditioning apparatus 100 according to Embodiment 2. Black arrows illustrated in FIG. 5 each indicate a flow direction of the refrigerant during the cooling operation. Outlined block arrows illustrated in FIG. 5 each indicate a flow direction of the air flow.

As illustrated in FIG. 5, in the air-conditioning apparatus 100 of Embodiment 2, the bypass valve 70 includes a capillary tube 70*b* in addition to the check valve 70*a*. The other configurations of the air-conditioning apparatus 100 are the same as the configurations of Embodiment 1 described above. Therefore, descriptions of the other configurations are omitted.

The capillary tube 70*b* is an expansion valve that is made of a thin and long copper tube, and allows a necessary amount of refrigerant to pass through the expansion valve by tube resistance to decompress the refrigerant. The capillary tube 70*b* is disposed between the check valve 70*a* and the coupling pipe 56.

In Embodiment 1 described above, it is described that the design of the load-side heat exchanger 5 is changeable in an optional combination, and the degree of freedom in design change is secured; however, the refrigerant pressure loss in the load-side heat exchanger 5 may be varied depending on the design change. For example, a ratio of the flow rate of the refrigerant flowing through the bypass pipe 60 to the flow rate of the refrigerant flowing through the first heat exchanger 52 is increased as the pressure loss of the first heat exchanger 52 is increased. In a case where the design is changed in which the load-side heat exchanger 5 is configured such that the flow resistance of the first heat exchanger 52 is increased and the refrigerant pressure loss is increased, the flow rate of the refrigerant passing through the bypass pipe 60 is excessive, so that heat transfer performance of the load-side heat exchanger 5 is reduced.

In the case where the bypass valve 70 includes the capillary tube 70*b*, it is possible to adjust the flow resistance of the bypass pipe 60 and to reduce the flow rate of the refrigerant passing through the bypass pipe 60. As a result, it is possible to maintain balance between the refrigerant pressure loss in the load-side heat exchanger 5 and the heat transfer performance of the load-side heat exchanger 5, and to further reduce the energy consumption.

Embodiment 3

Figure 6:
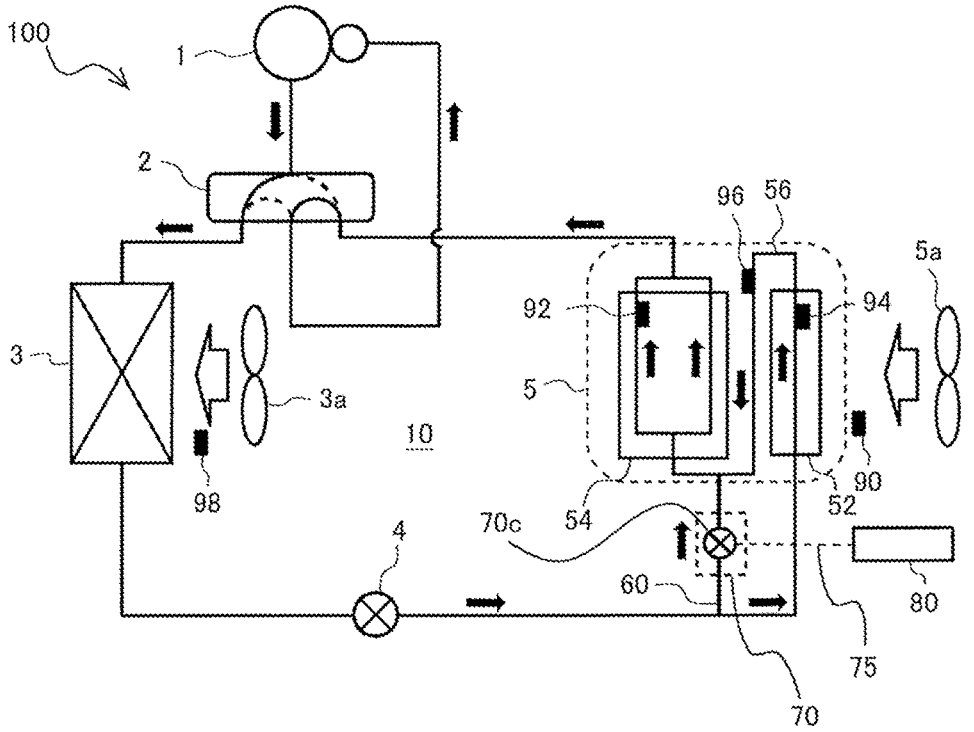
FIG. 6 is a schematic refrigerant circuit diagram illustrating an example of a refrigerant circuit during cooling operation of an air-conditioning apparatus according to Embodiment 3 of the present disclosure.

A configuration of the air-conditioning apparatus 100 of Embodiment 3 of the present disclosure will be described with reference to FIG. 6. FIG. 6 is a schematic refrigerant circuit diagram illustrating an example of the refrigerant circuit 10 during the cooling operation of the air-conditioning apparatus 100 according to Embodiment 3. Black arrows illustrated in FIG. 6 each indicate a flow direction of the refrigerant during the cooling operation. Outlined block arrows illustrated in FIG. 6 each indicate a flow direction of the air flow.

As illustrated in FIG. 6, in the air-conditioning apparatus 100 of Embodiment 3, the bypass valve 70 includes a flow control valve 70*c* having a controllable opening degree. The air-conditioning apparatus 100 further includes a controller 80 configured to control the opening degree of the flow control valve 70*c* through a communication line 75. The air-conditioning apparatus 100 further includes one or more temperature sensors connected to the controller 80 by a cable or radio. The other configurations of the air-conditioning apparatus 100 are the same as the configurations in Embodiment 1 described above. Therefore, descriptions of the other configurations are omitted.

The flow control valve 70*c* is a control device that controls the opening degree of an internal flow path to control the flow rate of the refrigerant flowing through the inside the flow control valve 70*c*. The flow control valve 70*c* is, for example, a linear electronic expansion valve. The flow control valve 70*c* is configured to control the flow rate of the refrigerant passing through the bypass pipe 60 in accordance with an instruction from the controller 80.

The controller 80 is, for example, dedicated hardware, a microcomputer including a central processing unit and a memory, or a micro processing unit. The controller 80 may be configured to exercise control of the operation state of the air-conditioning apparatus 100, for example, frequency control of the compressor 1 and opening degree control of the decompression device 4, or may only be configured to exercise the opening degree control of the flow control valve 70*c*. The communication line 75 between the flow control valve 70*c* and the controller 80 may be a cable or radio.

Each of the temperature sensors may include, for example, a semiconductor material such as a thermistor or a metal material such as a thermometric resistor. The plurality of temperature sensors provided in the air-conditioning apparatus 100 may have the same configuration or different configurations. In FIG. 6, connection lines between the controller 80 and the temperature sensors are not illustrated.

As illustrated in FIG. 6, the air-conditioning apparatus 100 may include, as the temperature sensors, a first temperature sensor 90, a second temperature sensor 92, a third temperature sensor 94, a fourth temperature sensor 96, and a fifth temperature sensor 98. The air-conditioning apparatus 100 may have a configuration from which some of the temperature sensors are removed, or a configuration to which a temperature sensor is further added, depending on the form of the air-conditioning apparatus 100.

The first temperature sensor 90 is disposed at an optional position around the load-side heat exchanger 5 and detects a temperature of the air-conditioned space. The second temperature sensor 92 detects a temperature of the refrigerant flowing through the second heat transfer tube 54*a*2 of the second heat exchanger 54, through the second heat transfer tube 54*a*2. The third temperature sensor 94 detects a temperature of the refrigerant flowing through the first heat transfer tube 52*a*2 of the first heat exchanger 52, through the first heat transfer tube 52*a*2. The fourth temperature sensor 96 detects a temperature of the refrigerant flowing through the coupling pipe 56, through the coupling pipe 56. The fifth temperature sensor 98 is an outside-air temperature sensor that is disposed at an optional position around the heat source-side heat exchanger 3, and detects a temperature of outside air. In the following description, in a case where it is unnecessary to distinguish the first temperature sensor 90, the second temperature sensor 92, the third temperature sensor 94, the fourth temperature sensor 96, and the fifth temperature sensor 98 from one another, these temperature sensors are simply referred to as the "temperature sensors".

Figure 7:
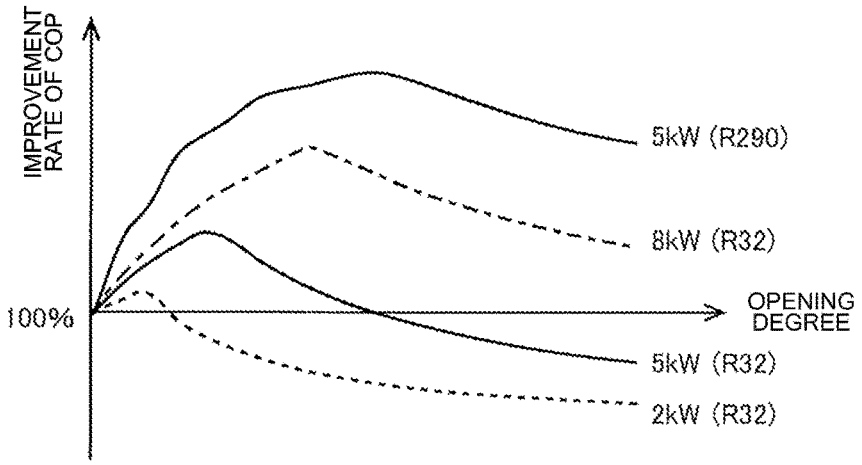
FIG. 7 is a graph illustrating a relationship between an opening degree of a flow control valve and a coefficient of performance during the cooling operation.

The controller 80 is configured to control the opening degree of the flow control valve 70*c* on the basis of information on an operation frequency transmitted from the compressor 1 and information on the temperatures detected by the respective temperature sensors. FIG. 7 is a graph illustrating a relationship between the opening degree of the flow control valve 70*c* and a coefficient of performance during the cooling operation. A horizontal axis illustrated in FIG. 7 refers to the opening degree of the flow control valve 70*c*, and the opening degree is increased in an arrow direction. A vertical axis illustrated in FIG. 7 refers to an improvement rate of the coefficient of performance that is defined such that the coefficient of performance is 100% when the flow control valve 70*c* is closed, namely, when the opening degree is zero. The coefficient of performance is increased in an arrow direction. In the following description, the coefficient of performance is described as its acronym "COP" in some cases. Further, the cooling capacity of each of lines in the graph is illustrated in kilowatts, and a type of the refrigerant is described in brackets.

As suggested in FIG. 7, in the case of an R32 refrigerant, the opening degree of the flow control valve 70*c* at which the improvement rate of the coefficient of performance becomes the highest during the cooling operation is varied depending on the cooling capacity of the air-conditioning apparatus 100, namely, a circulation amount of the refrigerant in the air-conditioning apparatus 100. In addition, as suggested in FIG. 7, increasing the opening degree of the flow control valve 70*c* with increase in the cooling capacity may improve the improvement rate of the coefficient of performance. The bypass valve 70 including the flow control valve 70*c* is provided and the opening degree of the flow control valve 70*c* is controlled depending on the cooling capacity, so that the balance is thus efficiently maintained between the refrigerant pressure loss in the load-side heat exchanger 5 and the heat transfer performance of the load-side heat exchanger 5.

Further, the cooling capacity of the air-conditioning apparatus 100 corresponds to the circulation amount of the refrigerant in the air-conditioning apparatus 100, and the circulation amount of the refrigerant in the air-conditioning apparatus 100 is increased with increase in the operation frequency of the compressor 1. Therefore, controlling the opening degree of the flow control valve 70*c* over an entire operable frequency range of the air-conditioning apparatus 100 makes it possible to more efficiently maintain the balance between the refrigerant pressure loss in the load-side heat exchanger 5 and the heat transfer performance of the load-side heat exchanger 5.

Further, as the controller 80 is provided, the opening degree of the flow control valve 70*c*, namely, the flow rate of the refrigerant passing through the bypass pipe 60 is adjustable to increase the coefficient of performance to the extent possible on the basis of the state during the cooling operation such as the temperature of the outside air, the temperature of the air-conditioned space, and the operation frequency of the compressor 1. As the flow control valve 70*c*, the controller 80, and the temperature sensors are provided, it is thus possible to further efficiently reduce the power consumption during a cooling period even in a case where any of the temperatures is varied.

Further, as suggested in FIG. 7, in comparison at the same refrigeration capacity, an R290 refrigerant may improve the improvement rate of the coefficient of performance by adjustment of the opening degree of the flow control valve 70*c* more than does the R32 refrigerant.

The bypass valve 70 in the air-conditioning apparatus 100 of Embodiment 3 may further include the check valve 70*a*.

Embodiment 4

Figure 8:
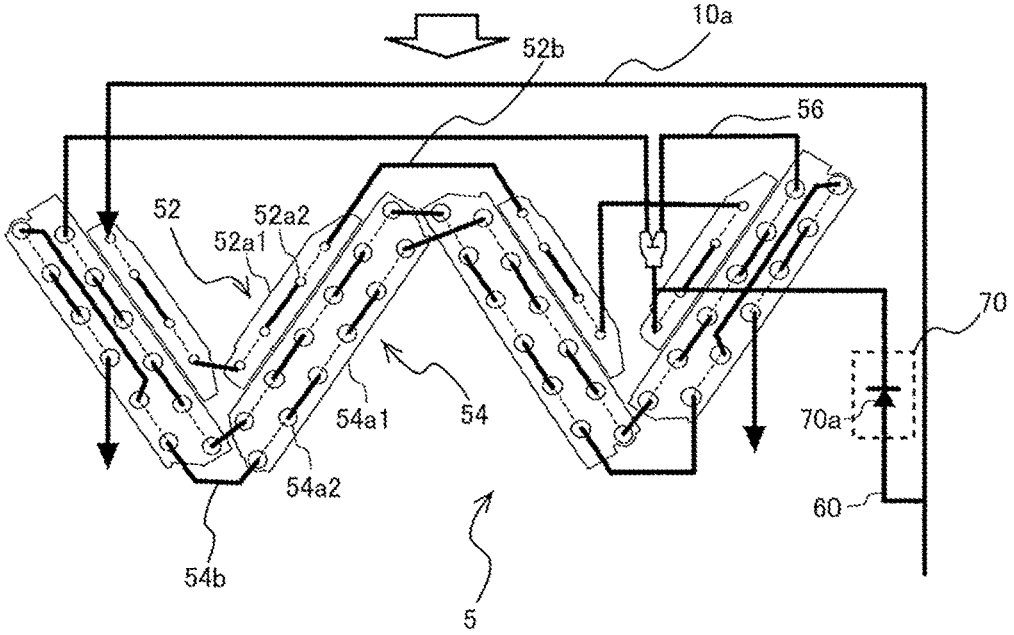
FIG. 8 is a schematic diagram illustrating an example of a specific configuration of a load-side heat exchanger during cooling operation of an air-conditioning apparatus according to Embodiment 4 of the present disclosure.

A configuration of the air-conditioning apparatus 100 of Embodiment 4 of the present disclosure will be described with reference to FIG. 8. FIG. 8 is a schematic diagram illustrating an example of a specific configuration of the load-side heat exchanger 5 during the cooling operation of the air-conditioning apparatus 100 according to Embodiment 4. An outlined block arrow illustrated in FIG. 8 indicates the direction of the flow of the air flow generated by the air-sending device 5*a*. Black arrows illustrated in FIG. 8 schematically indicate an inflow direction and an outflow direction of the refrigerant in the load-side heat exchanger 5 during the cooling operation of the air-conditioning apparatus 100.

As illustrated in FIG. 8, in the load-side heat exchanger 5, an inner diameter of the first heat transfer tube 52*a*2 of the first heat exchanger 52 is designed to be smaller than an inner diameter of the second heat transfer tube 54*a*2 of the second heat exchanger 54. The other configurations of the load-side heat exchanger 5 are the same as the configurations in Embodiment 1 described above. Therefore, descriptions of the other configurations are omitted.

For example, the load-side heat exchanger 5 is formed such that, in a case where a thickness of the first heat transfer tube 52*a*2 and a thickness of the second heat transfer tube 54*a*2 are equal to each other, an outer diameter of the second heat transfer tube 54*a*2 is 7 mm and an outer diameter of the first heat transfer tube 52*a*2 is 5 mm.

As the refrigerant circulating through the air-conditioning apparatus 100, a hydrocarbon refrigerant or a hydrofluorocarbon refrigerant, which are low in global warming potential, is used in some cases. With the hydrocarbon refrigerant, however, an amount of the refrigerant to be sealed is desirably small as the hydrocarbon refrigerant is flammable. Note that the hydrocarbon refrigerant is abbreviated as the HO refrigerant in some cases. Further, the hydrofluorocarbon refrigerant is abbreviated as the HFC refrigerant in some cases.

During the heating operation of the air-conditioning apparatus 100, the first heat exchanger 52 is used as a subcooling heat exchanger, and the liquid-phase refrigerant flows inside the first heat transfer tube 52*a*2. In a case where the liquid-phase refrigerant flows inside the first heat transfer tube 52*a*2, the flow speed of the refrigerant inside the first heat transfer tube 52*a*2 is increased as the inner diameter of the first heat transfer tube 52*a*2 is decreased. The heat transfer coefficient of the first heat transfer tube 52*a*2 is improved accordingly to improve the heating performance. Further, an internal capacity of the first heat transfer tube 52*a*2 is decreased as the inner diameter of the first heat transfer tube 52*a*2 is decreased. A filling amount of the refrigerant necessary for operation of the refrigerant circuit 10 is reduced accordingly.

During the cooling operation, the refrigerant pressure loss is increased as the inner diameter of the first heat transfer tube 52*a*2 is decreased and the flow rate of the refrigerant is increased. However, as described in Embodiments 1 to 3 described above, as the bypass pipe 60 and the bypass valve 70 are provided, the pressure loss in the first heat exchanger 52 is reduced to improve the cooling performance of the first heat exchanger 52 during the cooling operation.

Further, as described in Embodiment 1 described above, the first internal flow paths 52*b* of the first heat exchanger 52 may be designed to be smaller in number than the second internal flow paths 54*b* of the second heat exchanger 54. In a case where the liquid-phase refrigerant flows through the first internal flow path 52*b* during the heating operation of the air-conditioning apparatus 100, the flow speed of the refrigerant inside the first internal flow path 52*b* is increased as the number of first internal flow paths 52*b* is decreased. The heat transfer coefficient of the first heat transfer tube 52*a*2 is improved accordingly to improve the heating performance. In addition, the internal capacity of the first internal flow path 52*b* in the first heat exchanger 52 is decreased as the number of first internal flow paths 52*b* of the first heat exchanger 52 is decreased. The filling amount of the refrigerant necessary for operation of the refrigerant circuit 10 is reduced accordingly. As illustrated in FIG. 7, the load-side heat exchanger 5 may include, for example, one first internal flow path 52*b* and two second internal flow paths 54*b*.

During the cooling operation, the refrigerant pressure loss is increased as the number of first internal flow paths 52*b* is decreased and the flow rate of the refrigerant is increased. However, as the bypass pipe 60 and the bypass valve 70 are provided, the pressure loss in the first heat exchanger 52 is reduced to improve the cooling performance of the first heat exchanger 52 during the cooling operation.

Note that the outer diameter of the first heat transfer tube 52*a*2 and the outer diameter of the second heat transfer tube 54*a*2 are not limited to the above-described specific examples. When a tube having an inner diameter smaller than the inner diameter of the second heat transfer tube 54*a*2 having the outer diameter of 7 mm is used as the first heat transfer tube 52*a*2, similar effects are obtainable. Further, the number of first internal flow paths 52*b* and the number of second internal flow paths 54*b* are not limited to the above-described specific examples. For example, when the first heat transfer tube 52*a*2 is a flat tube, the number of internal flow paths may be two or more.

Figure 9:
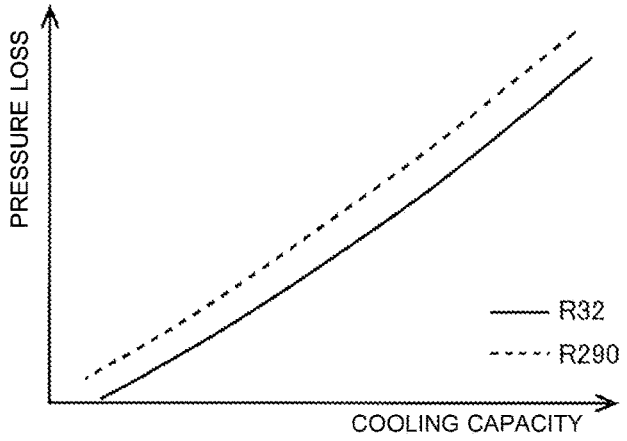
FIG. 9 is a graph illustrating a relationship between cooling capacity of the air-conditioning apparatus and pressure loss in the load-side heat exchanger in a case where an R290 refrigerant or an R32 refrigerant is used as refrigerant of the air-conditioning apparatus.

FIG. 9 is a graph illustrating a relationship between the cooling capacity of the air-conditioning apparatus 100 and the pressure loss in the load-side heat exchanger 5 in a case where the R290 refrigerant or the R32 refrigerant is used as the refrigerant of the air-conditioning apparatus 100. A horizontal axis of the graph refers to the cooling capacity of the air-conditioning apparatus 100, and the cooling capacity is improved in an arrow direction. A vertical axis of the graph refers to the pressure loss in the load-side heat exchanger 5, and the pressure loss is increased in an arrow direction. Further, the R290 refrigerant is a hydrocarbon refrigerant, and the R32 refrigerant is a hydrofluorocarbon refrigerant.

In a case where the same cooling capacity is required, use of the R290 refrigerant is constantly larger in pressure loss than use of the R32 refrigerant. As described in Embodiment 3 with reference to FIG. 7, however, in the comparison at the same refrigeration capacity, the R290 refrigerant may improve the improvement rate of the coefficient of performance by adjustment of the opening degree of the flow control valve 70*c* more than does the R32 refrigerant. Therefore, in particular, in the case where the hydrocarbon refrigerant is used as the refrigerant of the air-conditioning apparatus 100, it is possible to enhance effects of reducing the refrigerant amount and the energy consumption.

Further, when the coefficient of performance is enhanced at the constant cooling capacity, the power consumption of the air-conditioning apparatus 100 is decreased. Therefore, the air-conditioning apparatus 100 may also be configured to improve the cooling capacity at the constant power consumption to achieve an effect of improving the cooling capacity of the air-conditioning apparatus 100 to the extent possible.

REFERENCE SIGNS LIST

1: compressor, 2: refrigerant flow switching device, 2*a*: first port, 2*b*: second port, 2*c*: third port, 2*d*: fourth port, 3: heat source-side heat exchanger, 3*a*: heat source-side air-sending device, 4: decompression device, 5: load-side heat exchanger, 5*a*: air-sending device, 10: refrigerant circuit, 10*a*: first refrigerant pipe, 10*b*: second refrigerant pipe, 10*c*: third refrigerant pipe, 10*d*: fourth refrigerant pipe, 10*e*: fifth refrigerant pipe, 10*f*: sixth refrigerant pipe, 52: first heat exchanger, 52*a*: first heat exchange unit, 52*a*1: first fin, 52*a*2: first heat transfer tube, 52*b*: first internal flow path, 54: second heat exchanger, 54*a*: second heat exchange unit, 54*a*1: second fin, 54*a*2: second heat transfer tube, 54*b*: second internal flow path, 56: coupling pipe, 56*a*: branch portion, 60: bypass pipe, 60*a*: first bypass pipe, 60*b*: second bypass pipe, 70: bypass valve, 70*a*: check valve, 70*b*: capillary tube, 70*c*: flow control valve, 75: communication line, 80: controller, 90: first temperature sensor, 92: second temperature sensor, 94: third temperature sensor, 96: fourth temperature sensor, 98: fifth temperature sensor, 100: air-conditioning apparatus, 150: indoor unit

The invention claimed is:

1. An air-conditioning apparatus, comprising:

a refrigerant circuit through which refrigerant circulates, the refrigerant circuit including a compressor, a refrigerant flow switching device, a heat source-side heat exchanger, a decompression device, a load-side heat exchanger, a first refrigerant pipe, a coupling pipe, and a second refrigerant pipe, the load-side heat exchanger including a first heat exchanger and a second heat exchanger, the first refrigerant pipe connecting the decompression device and the first heat exchanger, the coupling pipe connecting the first heat exchanger and the second heat exchanger, the second refrigerant pipe connecting the second heat exchanger and the refrigerant flow switching device;

an air-sending device configured to generate an air flow passing through the load-side heat exchanger;

a bypass pipe connecting the first refrigerant pipe and the coupling pipe; and a bypass valve disposed in the bypass pipe, the refrigerant flow switching device being configured to switch between cooling operation that causes the refrigerant with low pressure flowing out from the load-side heat exchanger to be suctioned into the compressor and heating operation that causes the refrigerant with high pressure discharged from the compressor to flow into the load-side heat exchanger, the first heat exchanger being disposed on windward of the second heat exchanger in a direction of the air flow generated by the air-sending device, the air flow that passes through the first heat exchanger passing through the second heat exchanger, during the cooling operation, the bypass valve being configured to cause a part of the refrigerant flowing through the first refrigerant pipe to flow through the coupling pipe through the bypass pipe, during the heating operation, the bypass valve being configured to block a flow of the refrigerant flowing from the coupling pipe toward the first refrigerant pipe through the bypass pipe, and cause all of the refrigerant flowing through the coupling pipe to flow from the coupling pipe to the first heat exchanger.

2. The air-conditioning apparatus of claim 1, wherein the bypass valve includes a check valve.

3. The air-conditioning apparatus of claim 2, wherein the bypass valve further includes a capillary tube.

4. The air-conditioning apparatus of claim 1, wherein the bypass valve includes a flow control valve having a controllable opening degree.

5. The air-conditioning apparatus of claim 1, wherein the first heat exchanger includes at least one first internal flow path, the second heat exchanger includes at least one second internal flow path, and the at least one first internal flow path is smaller in number than the at least one second internal flow path.

6. The air-conditioning apparatus of claim 1, wherein the first heat exchanger includes a first heat transfer tube, the second heat exchanger includes a second heat transfer tube, and the first heat transfer tube has an inner diameter smaller than an inner diameter of the second heat transfer tube of the second heat exchanger.

7. The air-conditioning apparatus of claim 1, wherein the refrigerant is flammable.

8. The air-conditioning apparatus of claim 1, further comprising an indoor unit that houses the load-side heat exchanger, the air-sending device, the bypass pipe, and the bypass valve.

* * * * *